US011905791B2

(12) United States Patent
Al-Mousa

(10) Patent No.: US 11,905,791 B2
(45) Date of Patent: Feb. 20, 2024

(54) FLOAT VALVE FOR DRILLING AND WORKOVER OPERATIONS

(71) Applicant: Saudi Arabian Oil Company, Dhahran (SA)

(72) Inventor: Ahmed Al-Mousa, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 204 days.

(21) Appl. No.: 17/405,362

(22) Filed: Aug. 18, 2021

(65) Prior Publication Data

US 2023/0059642 A1 Feb. 23, 2023

(51) Int. Cl.

| | |
|---|---|
| ***E21B 34/14*** | (2006.01) |
| ***E21B 34/06*** | (2006.01) |
| ***E21B 21/10*** | (2006.01) |

(52) U.S. Cl.

CPC ..... *E21B 34/142* (2020.05); *E21B 21/103* (2013.01); *E21B 34/063* (2013.01); *E21B 2200/05* (2020.05)

(58) Field of Classification Search

CPC .... E21B 34/142; E21B 34/063; E21B 21/103; E21B 2200/05

See application file for complete search history.

(56) References Cited

U.S. PATENT DOCUMENTS 880,404 A 2/1908 Sanford
1,033,655 A 7/1912 Baker
(Continued)

FOREIGN PATENT DOCUMENTS

AU 636642 5/1993
AU 2007249417 11/2007
(Continued)

OTHER PUBLICATIONS

Al-Ansari et al., "Thermal Activated Resin to Avoid Pressure Build-Up in Casing-Casing Annulus (CCA)," SA-175425-MS, Society of Petroleum Engineers (SPE), presented at the SPE Offshore Europe Conference and Exhibition, Sep. 8-11, 2015, 11 pages.
(Continued)

*Primary Examiner* — Christopher J Sebesta
(74) *Attorney, Agent, or Firm* — Fish & Richardson P.C.

(57) ABSTRACT

A well system includes a tubular string comprising a plurality of tubular segments and positioned in a wellbore drilled into a subterranean zone, and a landing sub connected to a bottom end of one of the plurality of tubular segments. The landing sub includes a landing sub central bore and a landing sub locking profile on an inner surface of the landing sub central bore. The well system also includes a valve assembly configured to be pumped down the tubular string by fluid flowing in a downhole direction through the tubular string and to land within the landing sub central bore. The valve assembly includes a main body with a valve central bore and a flapper configured to pivot between an open position and a closed position. In the closed positon the flapper seals against a flapper seat and blocks fluid from flowing in an uphole direction through the valve central bore. The valve assembly also includes a rupture disc positioned in the valve central bore and configured to rupture in response to an application of a predetermined fluid pressure and configured to block fluid from flowing through the valve central bore when in an unruptured state. The valve assembly also includes one or more valve body setting dogs positioned on an outer surface of the main body and configured to lock into the landing sub locking profile and thereby limit axial movement of the main body within the landing sub.

12 Claims, 9 Drawing Sheets

(56) References Cited

U.S. PATENT DOCUMENTS 1,258,273 A 3/1918 Titus et al.
1,392,650 A 10/1921 Mcmillian
1,491,066 A 4/1924 Patrick
1,580,352 A 4/1926 Ercole
1,591,264 A 7/1926 Baash
1,621,947 A 3/1927 Moore
1,638,494 A 8/1927 Lewis et al.
1,789,993 A 1/1931 Switzer
1,896,236 A 2/1933 Howard
1,896,482 A 2/1933 Crowell
1,897,297 A 2/1933 Brown
1,949,498 A 3/1934 Frederick et al.
2,047,774 A 7/1936 Greene
2,121,002 A 6/1938 Baker
2,121,051 A 6/1938 Ragan et al.
2,187,487 A 1/1940 Burt
2,189,697 A 2/1940 Baker
2,222,233 A 11/1940 Mize
2,286,075 A 6/1942 Evans
2,304,793 A 12/1942 Bodine
2,316,402 A 4/1943 Canon
2,327,092 A 8/1943 Botkin
2,377,249 A 5/1945 Lawrence
2,411,260 A 11/1946 Glover et al.
2,481,637 A 9/1949 Yancey
2,546,978 A 4/1951 Collins et al.
2,638,988 A 5/1953 Williams
2,663,370 A 12/1953 Robert et al.
2,672,199 A 3/1954 McKenna
2,701,019 A 2/1955 Steed
2,707,998 A 5/1955 Baker et al.
2,708,973 A 5/1955 Twining
2,728,599 A 12/1955 Moore
2,734,581 A 2/1956 Bonner
2,745,693 A 5/1956 Mcgill
2,751,010 A 6/1956 Trahan
2,762,438 A 9/1956 Naylor
2,778,428 A 1/1957 Baker et al.
2,806,532 A 9/1957 Baker et al.
2,881,838 A 4/1959 Morse et al.
2,887,162 A 5/1959 Le Bus et al.
2,912,053 A 11/1959 Bruekelman
2,912,273 A 11/1959 Chadderdon et al.
2,915,127 A 12/1959 Abendroth
2,935,020 A 5/1960 Howard et al.
2,947,362 A 8/1960 Smith
2,965,175 A 12/1960 Ransom
2,965,177 A 12/1960 Le Bus et al.
2,965,183 A 12/1960 Le Bus et al.
3,005,506 A 10/1961 Le Bus et al.
3,023,810 A 3/1962 Anderson
3,116,799 A 1/1964 Lemons
3,147,536 A 9/1964 Lamphere
3,191,677 A 6/1965 Kinley
3,225,828 A 12/1965 Wisenbaker et al.
3,308,886 A 3/1967 Evans
3,352,593 A 11/1967 Webb
3,369,603 A 2/1968 Trantham
3,376,934 A 4/1968 William
3,380,528 A 4/1968 Durwood
3,381,748 A 5/1968 Peters et al.
3,382,925 A 5/1968 Jennings
3,409,084 A 11/1968 Lawson, Jr. et al.
3,437,136 A 4/1969 Young
3,554,278 A 1/1971 Reistle
3,667,721 A 6/1972 Vujasinovic
3,747,674 A 7/1973 Murray
3,752,230 A 8/1973 Bernat et al.
3,897,038 A 7/1975 Le Rouax
3,915,426 A 10/1975 Rouax
3,955,622 A 5/1976 Jones
4,030,354 A 6/1977 Scott
4,039,237 A 8/1977 Cullen et al.
4,039,798 A 8/1977 Lyhall et al.
4,042,019 A 8/1977 Henning
4,059,155 A 11/1977 Greer
4,099,699 A 7/1978 Allen
4,190,112 A 2/1980 Davis
4,215,747 A 8/1980 Cox
4,227,573 A 10/1980 Pearce et al.
4,254,983 A 3/1981 Harris
4,276,931 A 7/1981 Murray
4,285,400 A 8/1981 Mullins
4,289,200 A 9/1981 Fisher
4,291,722 A * 9/1981 Churchman ..... E21B 21/10 175/242
4,296,822 A 10/1981 Ormsby
4,325,534 A 4/1982 Roark et al.
4,349,071 A 9/1982 Fish
4,391,326 A 7/1983 Greenlee
4,407,367 A 10/1983 Kydd
4,412,130 A 10/1983 Winters
4,413,642 A 11/1983 Smith et al.
4,422,948 A 12/1983 Corley et al.
4,467,996 A 8/1984 Baugh
4,478,286 A 10/1984 Fineberg
4,515,212 A 5/1985 Krugh
4,538,684 A 9/1985 Sheffield
4,562,888 A 1/1986 Collet
4,603,578 A 8/1986 Stolz
4,611,658 A 9/1986 Salerni et al.
4,616,721 A 10/1986 Furse
4,696,502 A 9/1987 Desai
4,791,992 A 12/1988 Greenlee et al.
4,834,184 A 5/1989 Streich et al.
4,836,289 A 6/1989 Young
4,869,321 A 9/1989 Hamilton
4,877,085 A 10/1989 Pullig, Jr.
4,898,240 A 2/1990 Wittrisch
4,898,245 A 2/1990 Braddick
4,928,762 A 5/1990 Mamke
4,953,617 A 9/1990 Ross et al.
4,997,225 A 3/1991 Denis
5,012,863 A 5/1991 Springer
5,013,005 A 5/1991 Nance
5,054,833 A 10/1991 Bishop et al.
5,060,737 A 10/1991 Mohn
5,117,909 A 6/1992 Wilton et al.
5,129,956 A 7/1992 Christopher et al.
5,176,208 A 1/1993 Lalande et al.
5,178,219 A 1/1993 Streich et al.
5,197,547 A 3/1993 Morgan
5,203,646 A 4/1993 Landsberger et al.
5,295,541 A 3/1994 Ng et al.
5,330,000 A 7/1994 Givens et al.
5,343,946 A 9/1994 Morrill
5,348,095 A 9/1994 Worrall
5,358,048 A 10/1994 Brooks
5,392,715 A 2/1995 Pelrine
5,456,312 A 10/1995 Lynde et al.
5,468,153 A 11/1995 Brown et al.
5,507,346 A 4/1996 Gano et al.
5,580,114 A 12/1996 Palmer
5,584,342 A 12/1996 Swinford
5,605,366 A 2/1997 Beeman
5,639,135 A 6/1997 Beeman
5,667,015 A 9/1997 Harestad et al.
5,673,754 A 10/1997 Taylor
5,678,635 A 10/1997 Dunlap et al.
5,685,982 A 11/1997 Foster
5,697,441 A 12/1997 Vercaemer et al.
5,698,814 A 12/1997 Parsons
5,704,426 A 1/1998 Rytlewski et al.
5,775,420 A 7/1998 Mitchell et al.
5,806,596 A 9/1998 Hardy et al.
5,833,001 A 11/1998 Song et al.
5,842,518 A 12/1998 Soybel et al.
5,875,841 A 3/1999 Wright et al.
5,881,816 A 3/1999 Wright
5,887,668 A 3/1999 Haugen et al.
5,899,796 A 5/1999 Kamiyama et al.
5,924,489 A 7/1999 Hatcher
5,931,443 A 8/1999 Corte, Sr.
5,944,101 A 8/1999 Hearn

(56) References Cited

U.S. PATENT DOCUMENTS 5,996,712 A 12/1999 Boyd
6,070,665 A 6/2000 Singleton et al.
6,112,809 A 9/2000 Angle
6,130,615 A 10/2000 Poteet
6,131,675 A 10/2000 Anderson
6,138,764 A 10/2000 Scarsdale et al.
6,155,428 A 12/2000 Bailey et al.
6,247,542 B1 6/2001 Kruspe et al.
6,276,452 B1 8/2001 Davis et al.
6,371,204 B1 4/2002 Singh et al.
6,378,627 B1 4/2002 Tubel et al.
6,491,108 B1 12/2002 Slup et al.
6,510,900 B2 1/2003 Dallas
6,510,947 B1 1/2003 Schulte et al.
6,595,289 B2 7/2003 Tumlin et al.
6,637,511 B2 10/2003 Linaker
6,679,330 B1 1/2004 Compton et al.
6,688,386 B2 2/2004 Cornelssen
6,698,712 B2 3/2004 Milberger et al.
6,729,392 B2 5/2004 DeBerry et al.
6,768,106 B2 7/2004 Gzara et al.
6,808,023 B2 10/2004 Smith et al.
6,811,032 B2 11/2004 Schulte et al.
6,854,521 B2 2/2005 Echols et al.
6,880,639 B2 4/2005 Rhodes et al.
6,899,178 B2 5/2005 Tubel
6,913,084 B2 7/2005 Boyd
7,049,272 B2 5/2006 Sinclair et al.
7,051,810 B2 5/2006 Halliburton
7,082,994 B2 8/2006 Frost, Jr. et al.
7,090,019 B2 8/2006 Barrow et al.
7,096,950 B2 8/2006 Howlett et al.
7,117,941 B1 10/2006 Gano
7,117,956 B2 10/2006 Grattan et al.
7,128,146 B2 10/2006 Baugh
7,150,328 B2 12/2006 Marketz et al.
7,174,764 B2 2/2007 Oosterling et al.
7,188,674 B2 3/2007 McGavern, III et al.
7,188,675 B2 3/2007 Reynolds
7,218,235 B1 5/2007 Rainey
7,231,975 B2 6/2007 Lavaure et al.
7,249,633 B2 7/2007 Ravensbergen et al.
7,267,179 B1 9/2007 Abel
7,275,591 B2 10/2007 Allen et al.
7,284,611 B2 10/2007 Reddy et al.
7,303,010 B2 12/2007 de Guzman et al.
7,334,634 B1 2/2008 Abel
7,363,860 B2 4/2008 Wilson
7,383,889 B2 6/2008 Ring
7,389,817 B2 6/2008 Almdahl
7,398,832 B2 7/2008 Brisco
7,405,182 B2 7/2008 Verrett
7,418,860 B2 9/2008 Austerlitz et al.
7,424,909 B2 9/2008 Roberts et al.
7,487,837 B2 2/2009 Bailey et al.
7,488,705 B2 2/2009 Reddy et al.
7,497,260 B2 3/2009 Telfer
7,533,731 B2 5/2009 Corre
7,591,305 B2 9/2009 Brookey et al.
7,600,572 B2 10/2009 Slup et al.
7,617,876 B2 11/2009 Patel et al.
7,621,324 B2 11/2009 Atencio
7,712,527 B2 5/2010 Roddy
7,735,564 B2 6/2010 Guerrero
7,762,323 B2 7/2010 Frazier
7,762,330 B2 7/2010 Saylor, III et al.
7,802,621 B2 9/2010 Richards et al.
7,878,240 B2 2/2011 Garcia
7,934,552 B2 5/2011 La Rovere
7,965,175 B2 6/2011 Yamano
8,002,049 B2 8/2011 Keese et al.
8,056,621 B2 11/2011 Ring et al.
8,069,916 B2 12/2011 Giroux et al.
8,157,007 B2 4/2012 Nicolas
8,201,693 B2 6/2012 Jan
8,210,251 B2 7/2012 Lynde et al.
8,376,051 B2 2/2013 McGrath et al.
8,424,611 B2 4/2013 Smith et al.
8,453,724 B2 6/2013 Zhou
8,496,055 B2 7/2013 Mootoo et al.
8,579,024 B2 11/2013 Mailand et al.
8,579,037 B2 11/2013 Jacob
8,596,463 B2 12/2013 Burkhard
8,662,182 B2 3/2014 Redlinger et al.
8,726,983 B2 5/2014 Khan
8,770,276 B1 7/2014 Nish et al.
8,899,338 B2 12/2014 Elsayed et al.
8,991,489 B2 3/2015 Redlinger et al.
9,079,222 B2 7/2015 Burnett et al.
9,109,433 B2 8/2015 DiFoggio et al.
9,133,671 B2 9/2015 Kellner
9,163,469 B2 10/2015 Broussard et al.
9,181,782 B2 11/2015 Berube et al.
9,200,486 B2 12/2015 Leveau et al.
9,212,532 B2 12/2015 Leuchtenberg et al.
9,234,394 B2 1/2016 Wheater et al.
9,353,589 B2 5/2016 Hekelaar
9,359,861 B2 6/2016 Burgos
9,410,066 B2 8/2016 Ghassemzadeh
9,416,617 B2 8/2016 Wiese et al.
9,441,441 B1 9/2016 Hickie
9,441,451 B2 9/2016 Jurgensmeier
9,528,354 B2 12/2016 Loiseau et al.
9,551,200 B2 1/2017 Read et al.
9,574,417 B2 2/2017 Laird et al.
9,617,829 B2 4/2017 Dale et al.
9,657,213 B2 5/2017 Murphy et al.
9,784,073 B2 10/2017 Bailey et al.
9,903,192 B2 2/2018 Entchev
9,976,407 B2 5/2018 Ash et al.
10,024,154 B2 7/2018 Gray et al.
10,087,752 B2 10/2018 Bedonet
10,161,194 B2 12/2018 Clemens et al.
10,198,929 B2 2/2019 Snyder
10,202,817 B2 2/2019 Arteaga
10,266,698 B2 4/2019 Cano et al.
10,280,706 B1 5/2019 Sharp, III
10,301,898 B2 5/2019 Orban
10,301,989 B2 5/2019 Imada
10,544,640 B2 1/2020 Hekelaar et al.
10,584,546 B1 3/2020 Ford
10,626,698 B2 4/2020 Al-Mousa et al.
10,787,888 B2 9/2020 Andersen
10,837,254 B2 11/2020 Al-Mousa et al.
10,954,739 B2 3/2021 Sehsah et al.
10,975,654 B1 4/2021 Neacsu et al.
10,982,504 B2 4/2021 Al-Mousa et al.
11,008,824 B2 5/2021 Al-Mousa et al.
11,035,190 B2 6/2021 Neascu et al.
2002/0053428 A1 5/2002 Maples
2002/0060079 A1 5/2002 Metcalfe
2002/0129945 A1 9/2002 Brewer et al.
2002/0195252 A1 12/2002 Maguire
2003/0047312 A1 3/2003 Bell
2003/0098064 A1 5/2003 Kohli et al.
2003/0132224 A1 7/2003 Spencer
2003/0150608 A1 8/2003 Smith
2003/0221840 A1 12/2003 Whitelaw
2004/0031940 A1 2/2004 Biester
2004/0040707 A1 3/2004 Dusterhoft et al.
2004/0060700 A1* 4/2004 Vert ..... E21B 23/02 166/291
2004/0065446 A1 4/2004 Tran et al.
2004/0074819 A1 4/2004 Burnett
2004/0095248 A1 5/2004 Mandel
2004/0168796 A1 9/2004 Baugh et al.
2004/0216891 A1 11/2004 Maguire
2005/0024231 A1 2/2005 Fincher et al.
2005/0056427 A1 3/2005 Clemens et al.
2005/0087585 A1 4/2005 Copperthite et al.
2005/0167097 A1 8/2005 Sommers et al.
2005/0263282 A1 12/2005 Jeffrey et al.
2006/0082462 A1 4/2006 Crook

(56) References Cited

U.S. PATENT DOCUMENTS

2006/0102338 A1* 5/2006 Angman ..... E21B 21/10 166/242.8
2006/0105896 A1 5/2006 Smith et al.
2006/0243453 A1 11/2006 McKee
2007/0114039 A1 5/2007 Hobdy et al.
2007/0137528 A1 6/2007 Le Roy-Delage et al.
2007/0181304 A1 8/2007 Rankin et al.
2007/0204999 A1 9/2007 Cowie et al.
2007/0256864 A1 11/2007 Robichaux et al.
2007/0256867 A1 11/2007 DeGeare et al.
2008/0007421 A1 1/2008 Liu et al.
2008/0066912 A1 3/2008 Freyer et al.
2008/0087439 A1 4/2008 Dallas
2008/0236841 A1 10/2008 Howlett et al.
2008/0251253 A1 10/2008 Lumbye
2008/0314591 A1 12/2008 Hales et al.
2009/0194290 A1 8/2009 Parks et al.
2009/0250220 A1 10/2009 Stamoulis
2009/0308656 A1 12/2009 Chitwood
2010/0051265 A1 3/2010 Hurst
2010/0193124 A1 8/2010 Nicolas
2010/0258289 A1 10/2010 Lynde et al.
2010/0263856 A1 10/2010 Lynde et al.
2010/0270018 A1 10/2010 Howlett
2011/0036570 A1 2/2011 La Rovere et al.
2011/0056681 A1 3/2011 Khan
2011/0067869 A1 3/2011 Bour et al.
2011/0168411 A1 7/2011 Braddick
2011/0203794 A1 8/2011 Moffitt et al.
2011/0259609 A1 10/2011 Hessels et al.
2011/0273291 A1 11/2011 Adams
2011/0278021 A1 11/2011 Travis et al.
2012/0012335 A1 1/2012 White et al.
2012/0024546 A1* 2/2012 Rondeau ..... E21B 33/16 166/386
2012/0067447 A1 3/2012 Ryan et al.
2012/0085538 A1 4/2012 Guerrero
2012/0118571 A1 5/2012 Zhou
2012/0170406 A1 7/2012 DiFoggio et al.
2012/0205908 A1 8/2012 Fischer et al.
2012/0285684 A1 11/2012 Crow et al.
2013/0062055 A1 3/2013 Tolman
2013/0134704 A1 5/2013 Klimack
2013/0140022 A1 6/2013 Leighton
2013/0213654 A1 8/2013 Dewey et al.
2013/0240207 A1 9/2013 Frazier
2013/0269097 A1 10/2013 Alammari
2013/0296199 A1 11/2013 Ghassemzadeh
2013/0299194 A1 11/2013 Bell
2014/0090898 A1 4/2014 Moriarty
2014/0138091 A1 5/2014 Fuhst
2014/0158350 A1 6/2014 Castillo et al.
2014/0175689 A1 6/2014 Mussig
2014/0231068 A1 8/2014 Isaksen
2014/0251616 A1 9/2014 O'Rourke et al.
2015/0013994 A1 1/2015 Bailey et al.
2015/0096738 A1 4/2015 Atencio
2015/0152704 A1 6/2015 Tunget
2015/0275649 A1 10/2015 Orban
2016/0076327 A1 3/2016 Glaser et al.
2016/0084034 A1 3/2016 Roane et al.
2016/0130914 A1 5/2016 Steele
2016/0160106 A1 6/2016 Jamison et al.
2016/0237810 A1 8/2016 Beaman et al.
2016/0281458 A1 9/2016 Greenlee
2016/0305215 A1 10/2016 Harris et al.
2016/0340994 A1 11/2016 Ferguson et al.
2017/0044864 A1 2/2017 Sabins et al.
2017/0058628 A1 3/2017 Wijk et al.
2017/0067313 A1 3/2017 Connell et al.
2017/0089166 A1 3/2017 Sullivan
2018/0010418 A1 1/2018 VanLue
2018/0030809 A1 2/2018 Harestad et al.
2018/0058167 A1 3/2018 Finol et al.
2018/0112493 A1* 4/2018 Recchioni ..... E21B 34/10
2018/0175545 A1 6/2018 Engel et al.
2018/0187498 A1 7/2018 Soto et al.
2018/0209565 A1 7/2018 Lingnau
2018/0245427 A1 8/2018 Jimenez et al.
2018/0252069 A1 9/2018 Abdollah et al.
2019/0024473 A1 1/2019 Arefi
2019/0049017 A1 2/2019 McAdam et al.
2019/0087548 A1 3/2019 Bennett et al.
2019/0186232 A1 6/2019 Ingram
2019/0203551 A1 7/2019 Davis et al.
2019/0284894 A1 9/2019 Schmidt et al.
2019/0284898 A1 9/2019 Fagna et al.
2019/0301258 A1 10/2019 Li
2019/0316424 A1 10/2019 Robichaux et al.
2019/0338615 A1 11/2019 Landry
2020/0032604 A1 1/2020 Al-Ramadhan
2020/0056446 A1 2/2020 Al-Mousa et al.
2020/0240225 A1 7/2020 King et al.
2021/0025259 A1 1/2021 Al-Mousa et al.
2021/0054696 A1 2/2021 Golinowski et al.
2021/0054706 A1 2/2021 Al-Mousa et al.
2021/0054708 A1 2/2021 Al-Mousa et al.
2021/0054710 A1 2/2021 Neacsu et al.
2021/0054716 A1 2/2021 Al-Mousa et al.
2021/0131212 A1 5/2021 Al-Mousa et al.
2021/0131215 A1 5/2021 Al-Mousa et al.
2021/0140267 A1 5/2021 Al-Mousa et al.
2021/0198965 A1 7/2021 Al-Mousa et al.
2021/0215013 A1 7/2021 Neacsu et al.
2021/0230960 A1 7/2021 Al-Mousa

FOREIGN PATENT DOCUMENTS

CA 1329349 5/1994
CA 2441138 3/2004
CA 2624368 4/2011
CA 2762217 5/2015
CA 2802988 10/2015
CA 2879985 4/2016
CA 2734032 6/2016
CN 203292820 11/2013
CN 103785923 6/2016
CN 104712320 12/2016
CN 107060679 8/2017
CN 107191152 9/2017
CN 107227939 10/2017
CN 108756851 11/2018
DK 2545245 4/2017
DK 2236742 8/2017
EP 0792997 1/1999
EP 2119867 11/2009
EP 2737172 6/2014
EP 2964874 1/2016
EP 2545245 4/2017
ES 2275961 T5 3/2011
GB 958734 5/1964
GB 2021178 11/1979
GB 2203602 10/1988
GB 2392183 2/2004
GB 2396634 6/2004
GB 2414586 11/2005
GB 2425138 10/2006
GB 2427214 12/2006
GB 2453279 1/2009
GB 2492663 1/2014
GB 2546996 8/2017
JP 2001271982 10/2001
NO 333538 7/2013
NO 20170293 8/2018
OA 5503 A 4/1981
RU 2669969 10/2018
TW 201603922 2/2016
TW 201622853 7/2016
WO WO 1989012728 12/1989
WO WO 1996039570 12/1996
WO WO 2002090711 11/2002
WO WO 2004046497 6/2004
WO WO 2010132807 11/2010
WO WO 2012161854 11/2012

(56) References Cited

FOREIGN PATENT DOCUMENTS

| | | |
|---|---|---|
| WO | WO 2012164023 | 12/2012 |
| WO | WO 2013109248 | 7/2013 |
| WO | WO 2015112022 | 7/2015 |
| WO | WO 2016011085 | 1/2016 |
| WO | WO 2016040310 | 3/2016 |
| WO | WO 2016140807 | 9/2016 |
| WO | WO 2017043977 | 3/2017 |
| WO | WO 2018017104 | 1/2018 |
| WO | WO 2018164680 | 9/2018 |
| WO | WO 2019027830 | 2/2019 |
| WO | WO 2019132877 | 7/2019 |
| WO | WO 2019231679 | 12/2019 |

OTHER PUBLICATIONS

Al-Ibrahim et al., "Automated Cyclostratigraphic Analysis in Carbonate Mudrocks Using Borehole Images," Article #41425, posted presented at the 2014 AAPG Annual Convention and Exhibition, Search and Discovery, Apr. 6-9, 2014, 4 pages.

Bautista et al., "Probability-based Dynamic Time Warping for Gesture Recognition on RGB-D data," WDIA 2012: Advances in Depth Image Analysis and Application, 126-135, International Workshop on Depth Image Analysis and Applications, Nov. 2012, 11 pages.

Boriah et al., "Similarity Measures for Categorical Data: A Comparative Evaluation," presented at the SIAM International Conference on Data Mining, SDM 2008, Apr. 24-26, 2008, 12 pages.

Bruton et al., "Whipstock Options for Sidetracking," Oilfield Review, Spring 2014, 26:1, 10 pages.

Edwards et al., "Assessing Uncertainty in Stratigraphic Correlation: A Stochastic Method Based on Dynamic Time Warping," RM13, Second EAGE Integrated Reservoir Modelling Conference, Nov. 16-19, 2014, 2 pages.

Edwards, "Construction de modèles stratigraphiques à partir de données éparses," Stratigraphie, Université de Lorraine, 2017, 133 pages, English abstract.

Fischer, "The Lofer Cyclothems of the Alpine Triassic," published in Merriam, Symposium on Cyclic Sedimentation: Kansas Geological Survey (KGS), Bulletin, 1964, 169: 107-149, 50 pages.

Forum Energy Technologies "Drill Pipe Float Valves," 2019, Catalog, 6 pages.

Hernandez-Vela et al., "Probability-based Dynamic Time Warping and Bag-of-Visual- and-Depth-Words for human Gesture Recognition in RGB-D," Pattern Recognition Letters, Dec. 2014, 50: 112-121, 10 pages.

Herrera and Bann, "Guided seismic-to-well tying based on dynamic time warping," SEG Las Vegas 2012 Annual Meeting, Nov. 2012, 6 pages.

Hydril "Checkguard" Kellyguard Drill Stem Valves, Catalog DSV 2003, Brochure, 9 pages.

Keogh and Ratanamahatana, "Exact indexing of dynamic time warping," Knowledge and Information Systems, Springer-Verlag London Ltd., 2004, 29 pages.

Lallier et al., "3D Stochastic Stratigraphic Well Correlation of Carbonate Ramp Systems," IPTC 14046, International Petroleum Technology Conference (IPTC), presented at the International Petroleum Technology Conference, Dec. 7-9, 2009, 5 pages.

Lallier et al., "Management of ambiguities in magnetostratigraphic correlation," Earth and Planetary Science Letters, Jun. 2013, 371-372: 26-36, 11 pages.

Lallier et al., "Uncertainty assessment in the stratigraphic well correlation of a carbonate ramp: Method and application of the Beausset Basin, SE France," C. R. Geoscience, Sep. 2016, 348: 499-509, 11 pages.

Lineman et al., "Well to Well Log Correlation Using Knowledge-Based Systems and Dynamic Depth Warping," SPWLA Twenty-Eighth Annual Logging Symposium, Jun. 29-Jul. 2, 1987, 25 pages.

Nakanishi and Nakagawa, "Speaker-Independent Word Recognition by Less Cost and Stochastic Dynamic Time Warping Method," ISCA Archive, European Conference on Speech Technology, Sep. 1987, 4 pages.

Packardusa.com [online], "Drop-in Check Valves," Packard International, available on or before Jul. 6, 2007, via Internet Archive: Wayback Machine URL <http://web.archive.org/web/20070706210423/http://packardusa.com/productsandservices5.asp>, retrieved on May 11, 2021, URL <www.packardusa.com/productsandservices5.asp>, 2 pages.

Pels et al., "Automated biostratigraphic correlation of palynological records on the basis of shapes of pollen curves and evaluation of next-best solutions," Paleogeography, Paleoclimatology, Paleoecology, Aug. 1996, 124: 17-37, 21 pages.

Pollack et al., "Automatic Well Log Correlation," AAPG Annual Convention and Exhibition, Apr. 3, 2017, 1 page, Abstract Only.

Rudman and Lankston, "Stratigraphic Correlation of Well Logs by Computer Techniques," The American Association of Petroleum Geologists, Mar. 1973, 53:3 (557-588), 12 pages.

Sakoe and Chiba, "Dynamic Programming Algorithm Optimization for Spoken Word Recognition," IEEE Transactions on Acoustics, Speech and Signal Processing, ASSP-26:1, Feb. 1978, 7 pages.

Salvador and Chan, "FastDTW: Toward Accurate Dynamic Time Warping in Linear Time and Space," presented at the KDD Workshop on Mining Temporal and Sequential Data, Intelligent Data Analysis, Jan. 2004, 11:5 (70-80), 11 pages.

Sayhi, "peakdet: Peak detection using MATLAB," Jul. 2012, 4 pages.

Scribd.com [online], "Milling Practices and Procedures," retrieved from URL <https://www.scribd.com/document/358420338/Milling-Rev-2-Secured>, 80 pages.

Silva and Koegh, "Prefix and Suffix Invariant Dynamic Time Warping," IEEE Computer Society, presented at the IEEE 16th International Conference on Data Mining, Dec. 2016, 6 pages.

Smith and Waterman, "New Stratigraphic Correlation Techniques," Journal of Geology, Jul. 1980, 88: 451-457, 8 pages.

Startzman and Kuo, "A Rule-Based System for Well Log Correlation," SPE Formative Evaluation, Society of Petroleum Engineers (SPE), Sep. 1987, 9 pages.

TAM International Inflatable and Swellable Packers, "TAM Scab Liner brochure," Tam International, available on or before Nov. 15, 2016, 4 pages.

Tomasi et al., "Correlation optimized warping and dynamic time warping as preprocessing methods for chromatographic data," Journal of Chemometrics, 2004, 18: 231-241, 11 pages.

Uchida et al., "Non-Markovian Dynamic Time Warping," presented at the 21st International Conference on Pattern Recognition (ICPR), Nov. 11-15, 2012, 4 pages.

Waterman and Raymond, "The Match Game: New Stratigraphic Correlation Algorithms," Mathematical Geology, 1987, 19:2, 19 pages.

Weatherford, "Micro-Seal Isolation System-Bow (MSIS-B)," Weatherford Swellable Well Construction Products, Brochure, 2009-2011, 2 pages.

Zoraster et al., "Curve Alignment for Well-to-Well Log Correlation," SPE 90471, Society of Petroleum Engineers (SPE), presented at the SPE Annual Technical Conference and Exhibition, Sep. 26-29, 2004, 6 pages.

* cited by examiner

FLOAT VALVE FOR DRILLING AND WORKOVER OPERATIONS

TECHNICAL FIELD

This disclosure relates to wellbore drilling and workover equipment, and in particular a float valve, system, and method.

BACKGROUND

Float valves, or non-return valves, are downhole safety valves that create barriers to prevent unwanted flow of fluids up a drill string or other tubular string for drilling, workover, or other operations in a wellbore. The unwanted flow can be because of pressure changes or due to a well control event.

SUMMARY

This disclosure describes a non-return float valve, system, and method for a drill string or other tubular string in a wellbore.

Certain aspects of the subject matter herein can be implemented as a well system. The well system includes a tubular string comprising a plurality of tubular segments and positioned in a wellbore drilled into a subterranean zone, and a landing sub connected to a bottom end of one of the plurality of tubular segments. The landing sub includes a landing sub central bore and a landing sub locking profile on an inner surface of the landing sub central bore. The well system also includes a valve assembly configured to be pumped down the tubular string by fluid flowing in a downhole direction through the tubular string and to land within the landing sub central bore. The valve assembly includes a main body with a valve central bore and a flapper configured to pivot between an open position and a closed position. In the closed positon the flapper seals against a flapper seat and blocks fluid from flowing in an uphole direction through the valve central bore. The valve assembly also includes a rupture disc positioned in the valve central bore and configured to rupture in response to an application of a predetermined fluid pressure and configured to block fluid from flowing through the valve central bore when in an unruptured state. The valve assembly also includes one or more valve body setting dogs positioned on an outer surface of the main body and configured to lock into the landing sub locking profile and thereby limit axial movement of the main body within the landing sub.

An aspect combinable with any of the other aspects can include the following features. The valve assembly is configured to, when the rupture disc is in the ruptured state, allow fluid to flow through the valve central bore in a downhole direction and to prevent the flow of fluid in the uphole direction.

An aspect combinable with any of the other aspects can include the following features. The tubular string is a drill string. The well system also includes a bottomhole assembly connected to the tubular string below the landing sub. The bottomhole assembly includes a drill bit and is configured to further drill the wellbore into the subterranean zone.

An aspect combinable with any of the other aspects can include the following features. The fluid is drilling fluid.

An aspect combinable with any of the other aspects can include the following features. The valve assembly also includes an internal locking profile on an inner surface of the valve central bore. The well system further includes a retrieval tool configured to be lowered into the tubular string and at least partially into the valve central bore, the retrieval tool comprising retrieval tool dogs configured to lock into the internal locking profile of the valve assembly and operable to pull the valve assembly in an uphole direction from the landing sub.

An aspect combinable with any of the other aspects can include the following features. The flapper is biased to the closed positon by a spring and the predetermined fluid pressure to rupture the rupture disc is greater than a fluid pressure required to push the flapper to the open position.

An aspect combinable with any of the other aspects can include the following features. The valve body setting dogs are biased outward by springs within the valve main body and wherein the predetermined fluid pressure to rupture the rupture disc is greater than a fluid pressure against the rupture disc that is required to push the valve assembly in a downhole direction into the landing sub such that the valve body setting dogs lock into the landing sub locking profile.

An aspect combinable with any of the other aspects can include the following features. The valve assembly is a secondary check valve assembly. The well system also includes a primary check valve assembly installed in the tubular string below the landing sub, the primary check valve assembly configured to allow the flow of fluids in the downhole direction and to prevent the flow of fluids in the uphole direction in the tubular string, and wherein the secondary check valve assembly is operable to prevent the flow of fluids in the uphole direction in the tubular string in the event of a failure of the primary check valve assembly.

Certain aspects of the subject matter herein can be implemented as a valve assembly. The valve assembly includes a main body with a valve central bore and is configured to be pumped down a tubular string and to land within a central landing sub bore of a landing sub connected to a bottom end of a tubular segment of the tubular string, which is positioned in a wellbore drilled into a subterranean zone. The valve assembly also includes a flapper configured to pivot between an open position and a closed position, wherein in the closed positon the flapper seals against a flapper seat and blocks fluid from flowing through the central valve bore in an uphole direction. The valve assembly also includes a rupture disc configured to rupture in response to an application of a predetermined fluid pressure applied through the valve central bore and configured to block fluid from flowing through the central valve bore when in an unruptured state. The valve assembly also includes one or more valve body setting dogs configured to lock into a locking profile on an inner surface of the landing sub.

An aspect combinable with any of the other aspects can include the following features. The valve assembly is configured to, when the rupture disc is in the ruptured state, allow fluid to flow through the valve central bore in a downhole direction and to prevent the flow of fluid in the uphole direction.

An aspect combinable with any of the other aspects can include the following features. The tubular string is a drill string.

An aspect combinable with any of the other aspects can include the following features. The fluid is drilling fluid.

An aspect combinable with any of the other aspects can include the following features. The valve assembly also includes an internal locking profile on an inner surface of the valve central bore and is configured to receive a retrieval tool configured to be lowered into the tubular string and at least partially into the valve central bore. The retrieval tool includes retrieval tool dogs configured to lock into the internal locking profile of the valve assembly and configured to pull the valve assembly from the landing sub.

An aspect combinable with any of the other aspects can include the following features. The flapper is biased to the closed positon by a spring and the predetermined fluid pressure to rupture the rupture disc is greater than a fluid pressure required to push the flapper to the open position.

An aspect combinable with any of the other aspects can include the following features. The valve body setting dogs are biased outward by springs within the valve main body and the predetermined fluid pressure to rupture the rupture disc is greater than a fluid pressure against the rupture disc that is required to push the valve assembly into the landing sub such that the valve body setting dogs lock into the landing sub locking profile.

Certain aspects of the subject matter herein can be implemented as a method. The method includes attaching a landing sub to a bottom end of one of a plurality of tubular segments of a tubular string, the landing sub comprising a landing sub central bore and a landing sub locking profile on an inner surface of the landing sub central bore. The method also includes lowering the tubular string into a wellbore drilled into a subterranean zone and pumping, by a flow of fluid through the tubular string, a valve assembly in a downhole direction through the tubular string until the valve assembly lands within the landing sub central bore and valve body setting dogs positioned on an outer surface of a main body of the valve assembly lock into the landing sub locking profile. The valve assembly includes a flapper configured to pivot between an open position and a closed position. In the closed positon the flapper seals against a flapper seat and blocks fluid from flowing in an uphole direction through the valve central bore. The valve assembly also includes a rupture disc positioned in the valve central bore and configured to rupture in response to an application of a predetermined fluid pressure and to block fluid from flowing through the valve central bore when in an unruptured state. The method also includes increasing a fluid pressure of the fluids in the tubular string until the rupture disc ruptures.

An aspect combinable with any of the other aspects can include the following features. The valve assembly is configured to, when the rupture disc is in the ruptured state, allow fluid to flow through the valve central bore in a downhole direction and to prevent the flow of fluid in the uphole direction.

An aspect combinable with any of the other aspects can include the following features. The method also includes pivoting, by flowing fluid in a downhole direction, the flapper to the open position, and flowing fluid in a downhole direction through the tubular string and through the valve assembly to a downhole end of the tubular string below the landing sub.

An aspect combinable with any of the other aspects can include the following features. The method also includes pivoting, in response to a flow of fluid in an uphole direction, the flapper to the closed position.

An aspect combinable with any of the other aspects can include the following features. The tubular string is a drill string. A bottomhole assembly is connected to a tubular segment below the landing sub. The bottomhole assembly includes a drill bit, and the method also includes further drilling the wellbore into the subterranean zone with the drill bit.

An aspect combinable with any of the other aspects can include the following features. The method also includes flowing drilling fluid in a downhole direction through the tubular string and through the valve assembly to the drill bit.

An aspect combinable with any of the other aspects can include the following features. The valve assembly also includes an internal locking profile on an inner surface of the valve central bore. The method also includes lowering a retrieval tool into the tubular string and at least partially into the valve central bore, the retrieval tool comprising retrieval tool dogs configured to lock into the internal locking profile of the valve assembly, and pulling, with the retrieval tool, the valve assembly in an uphole direction from the landing sub.

An aspect combinable with any of the other aspects can include the following features. The flapper is biased to the closed positon by a spring and the predetermined fluid pressure to rupture the rupture disc is greater than a fluid pressure required to push the flapper to the open position.

An aspect combinable with any of the other aspects can include the following features. The valve body setting dogs are biased outward by springs within the valve main body and wherein the predetermined fluid pressure to rupture the rupture disc is greater than a fluid pressure against the rupture disc that is required to push the valve assembly in a downhole direction into the landing sub such that the valve body setting dogs lock into the landing sub locking profile.

An aspect combinable with any of the other aspects can include the following features. The method also includes installing, before the tubular string is lowered into the wellbore into the subterranean zone, a primary check valve assembly in the tubular string below the landing sub. The primary check valve assembly is configured to allow the flow of fluids in the downhole direction and to prevent the flow of fluids in the uphole direction in the tubular string. The valve assembly pumped through the tubular string is a secondary check valve assembly operable to prevent the flow of fluids in the uphole direction in the tubular string in the event of a failure of the primary check valve assembly.

The details of one or more implementations of the subject matter of this disclosure are set forth in the accompanying drawings and the description. Other features, aspects, and advantages of the subject matter will become apparent from the description, the drawings, and the claims.

DETAILED DESCRIPTION

The present disclosure is directed to fluid flow control in downhole tubular strings. Particularly, the present disclosure is directed to a non-return float valve, system, and method for a drill string or other tubular string in a wellbore.

In drilling, completion, workover, or other wellbore operations, it is sometimes desirable to allow fluid to flow in a downhole direction through a tubular string but not in an uphole direction. For example, in drilling operations, drilling mud or other drilling fluid is pumped downhole to operate the bit and to wash cuttings away from the bit face and back up the annulus. Undesirable reverse flow in an uphole direction through the drill string might be encountered either due to a U-tube effect when the bulk density of the mud in the annulus is higher than that inside the drillpipe, or a well control event. Float valves (sometimes called non-return valves or check valves) are sometimes positioned in drill strings, workover strings, and other downhole tubular strings to allow fluid flow through the string in a downhole direction but prevent fluid flow in an uphole direction.

Float valves can be installed in a tubular string before insertion of the string in the wellbore, or, in some configurations, can be dropped into the tubular string and pumped down and landed into a landing sub configured to receive and lock the valve into place. In some embodiments of the present disclosure, a valve assembly includes a rupture disc which enables the valve assembly to be pumped downhole at greater speed and with greater force to properly lock into the landing sub than if no rupture disc was present. In some embodiments of the present invention, a flapper is used as the closure device to prevent flow in the uphole direction (once the valve assembly is landed and the rupture disc is ruptured), which allows for a larger flow area and thus a larger volume of fluid to be pumped downhole than other types of closure mechanisms such as poppet valves. In addition, because almost the entire cross-sectional flow area is open when the flapper is open, tools and other components can be passed through the central bore of the valve when in the open position, which may not be possible with other closure types. The rupture disc allows for a high fluid pressure and flow rate to be used to quickly pump the valve downhole and forcefully latch it into the landing sub; however, only a relatively low fluid pressure and flow rate in a downhole direction is required to keep the flapper open (after the valve assembly is landed and the rupture disc is ruptured).

Figure 1A:
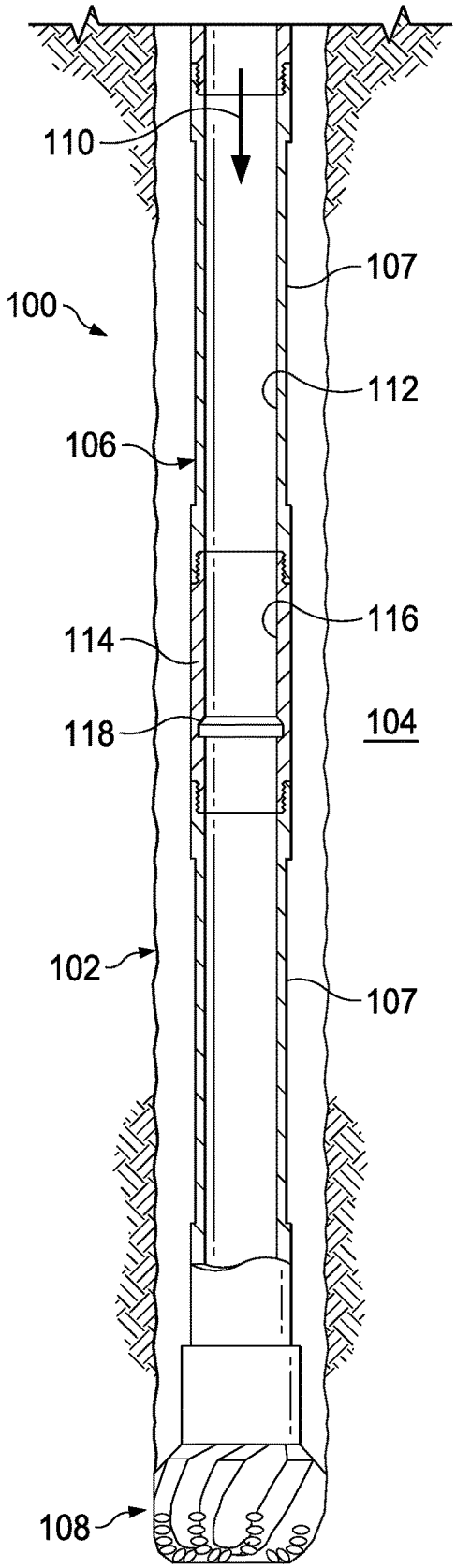
FIGS. 1A-1C are schematic diagrams of a well system including a landing sub and valve assembly in accordance with an embodiment of the present disclosure.
Figure 1B:
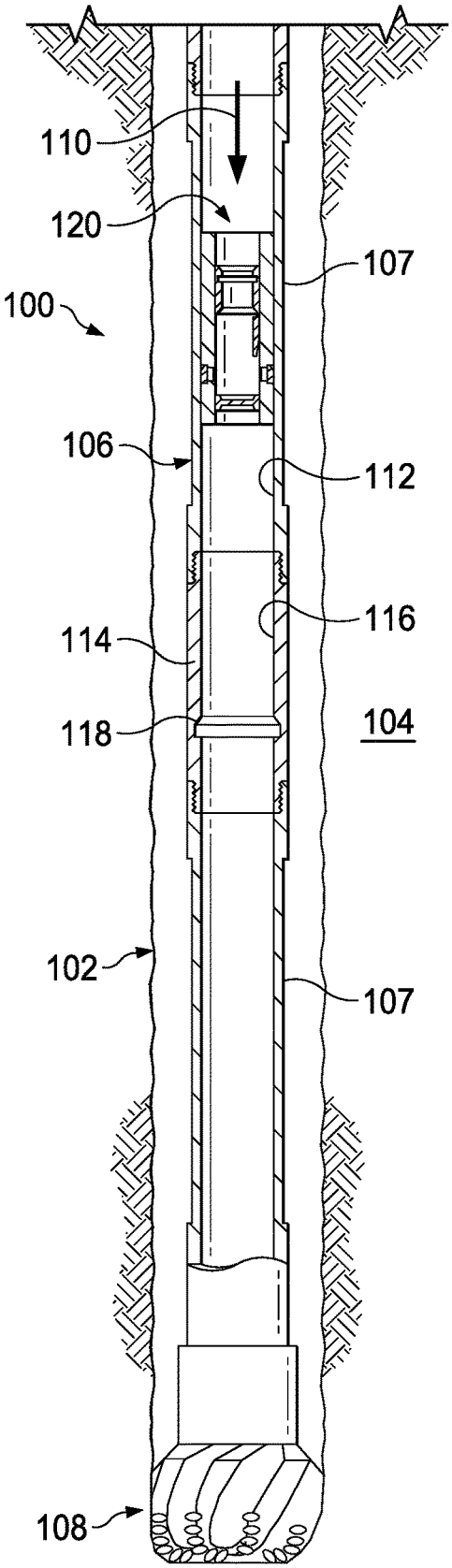
Figure 1C:
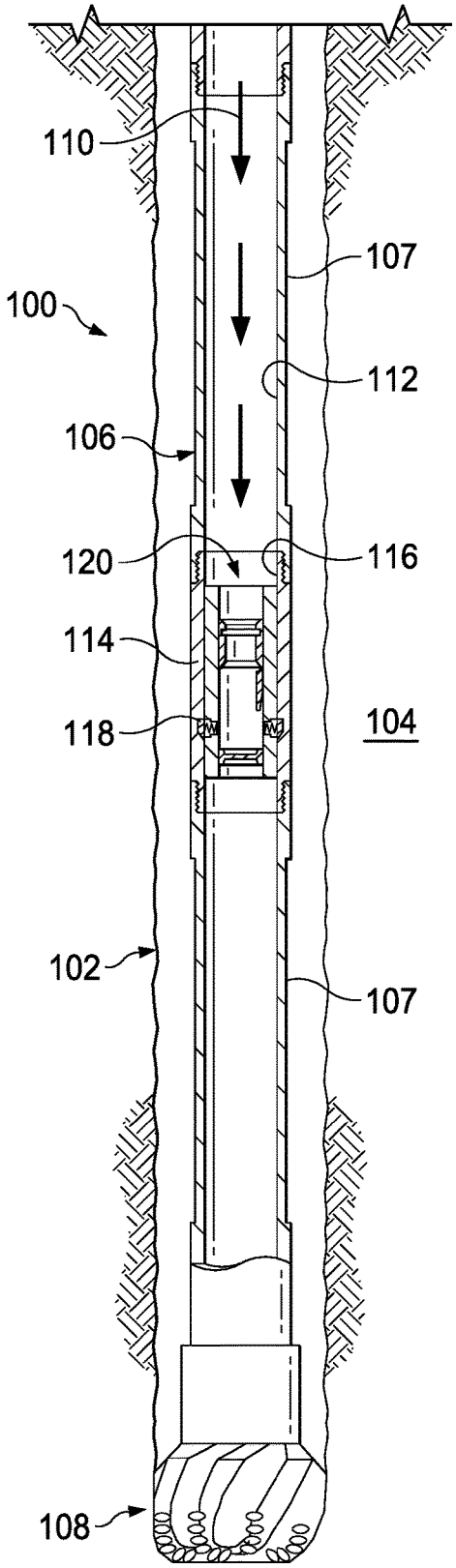

FIGS. 1A-1C are schematic diagrams of a well system including a landing sub and valve assembly in accordance with an embodiment of the present disclosure. Referring to FIG. 1A, system 100 includes wellbore 102 drilled into subterranean zone 104. Tubular string 106 is made up of a plurality of tubular segments 107 and has a tubular string central bore 112 through which fluids 110 can flow. In the illustrated embodiment, tubular string 106 is a drill string, tubular segments 107 are drill string segments, and fluid 110 is drilling fluid pumped in a downhole direction towards bottomhole assembly 108. Bottomhole assembly 108 can include a drill bit and other components for drilling wellbore 102. In other embodiments, tubular string 106 can be a workover string, production tubing string, or other suitable string of tubular segments for performing drilling, workover, or other downhole operations.

Tubular string 106 further includes a landing sub 114 connected to a bottom end of one of the tubular segments 107. Landing sub 114 includes a landing sub central bore 116, the centerline axis of which is in alignment with the centerline axis of the rest of tubular string central bore 112. Landing sub 114 further includes a landing sub locking profile 116 on an inner surface of the landing sub central bore 116.

Referring to FIG. 1B, a valve assembly 120 can be dropped into tubular string central bore 112 from a surface location and fall via gravity and/or by force of fluid 110 being pumped in the downhole direction. As described in greater detail in reference to FIG. 2, valve assembly 120 includes a setting dog or dogs that can latch into landing sub locking profile 116 and thereby limit axial movement of valve assembly 120 when valve assembly 120 lands in landing sub 114, as shown in FIG. 1C and in greater detail in FIGS. 3A and 3B.

Figure 2:
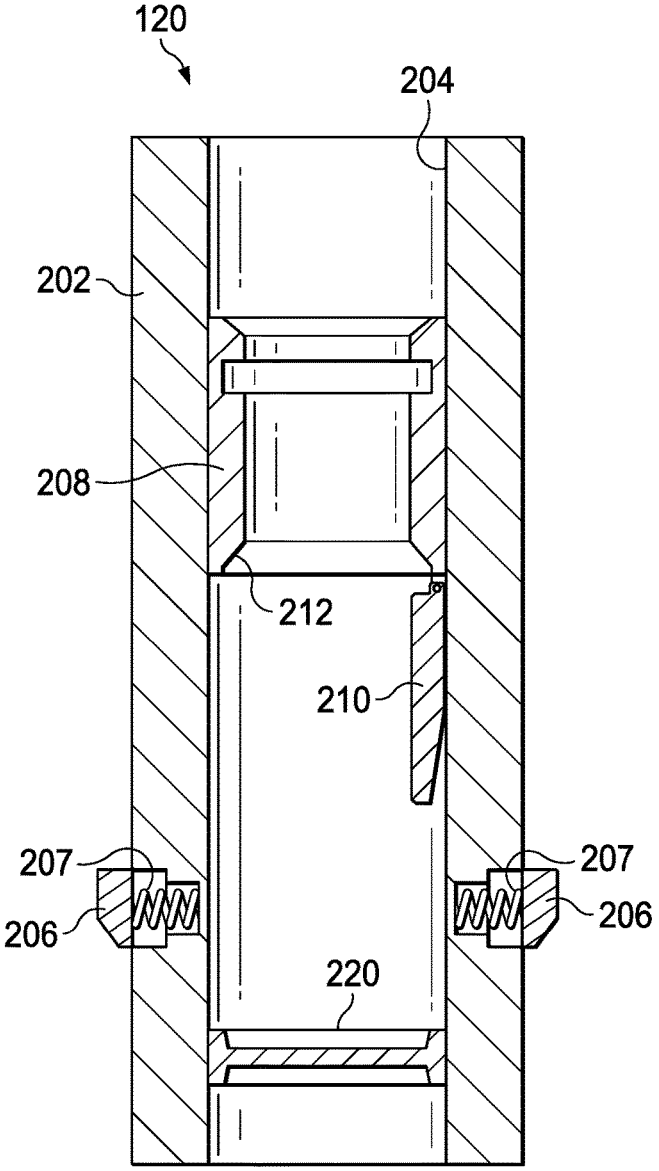
FIG. 2 is a schematic diagram of a valve assembly in accordance with an embodiment of the present disclosure.

FIG. 2 is a schematic diagram showing greater detail of valve assembly 120 of FIGS. 1B and 1C. In the illustrated embodiment, valve assembly 120 is a float valve for a drill string. In other embodiments, valve assembly 120 can be a check valve for a workover string or another application or operation in which it is desirable for fluid to be prevented from flowing in an uphole direction through tubular string 106. Referring to FIG. 2, valve assembly 120 includes a main body 202 and a valve central bore 204. Setting dogs 206 are configured to latch into the locking profile 116 of landing sub 114, as shown in FIG. 1C. As shown in greater detail in FIGS. 3A and 3B, springs 207 bias the setting dogs 206 in an outward direction. Valve assembly 120 further includes a flapper 210 that can pivot between an open position and a closed position. Valve assembly 120 is configured to be installed in a landing sub in a tubular string in a wellbore (such as landing sub 114 of FIGS. 1A-1C) such that flapper 210 opens in the downhole direction, and such that fluid flow in an uphole direction pushes flapper 210 to the closed position. In the closed positon, flapper 210 seals against flapper seat 212 and blocks fluid from flowing through valve central bore 204. When pivoted to the open position, flapper 210 is clear of valve central bore 210, providing the full flow area of central bore 204 for the flow of fluids and allowing for access of tools or other components through valve central bore 204.

Valve assembly 120 also includes a rupture disc 220 in valve central bore 204. Rupture disc 220 can comprise steel or other metallic material, frangible ceramic, polymer, or other suitable material. When in an unruptured state, rupture disc 220 blocks the flow of fluid through valve central bore 204. When in the rupture state, fluid can flow through the valve central bore 204 (if flapper 210 is in the open position). Rupture disc 220 can be configured to rupture in response to an application of a predetermined fluid pressure.

Figure 3A:
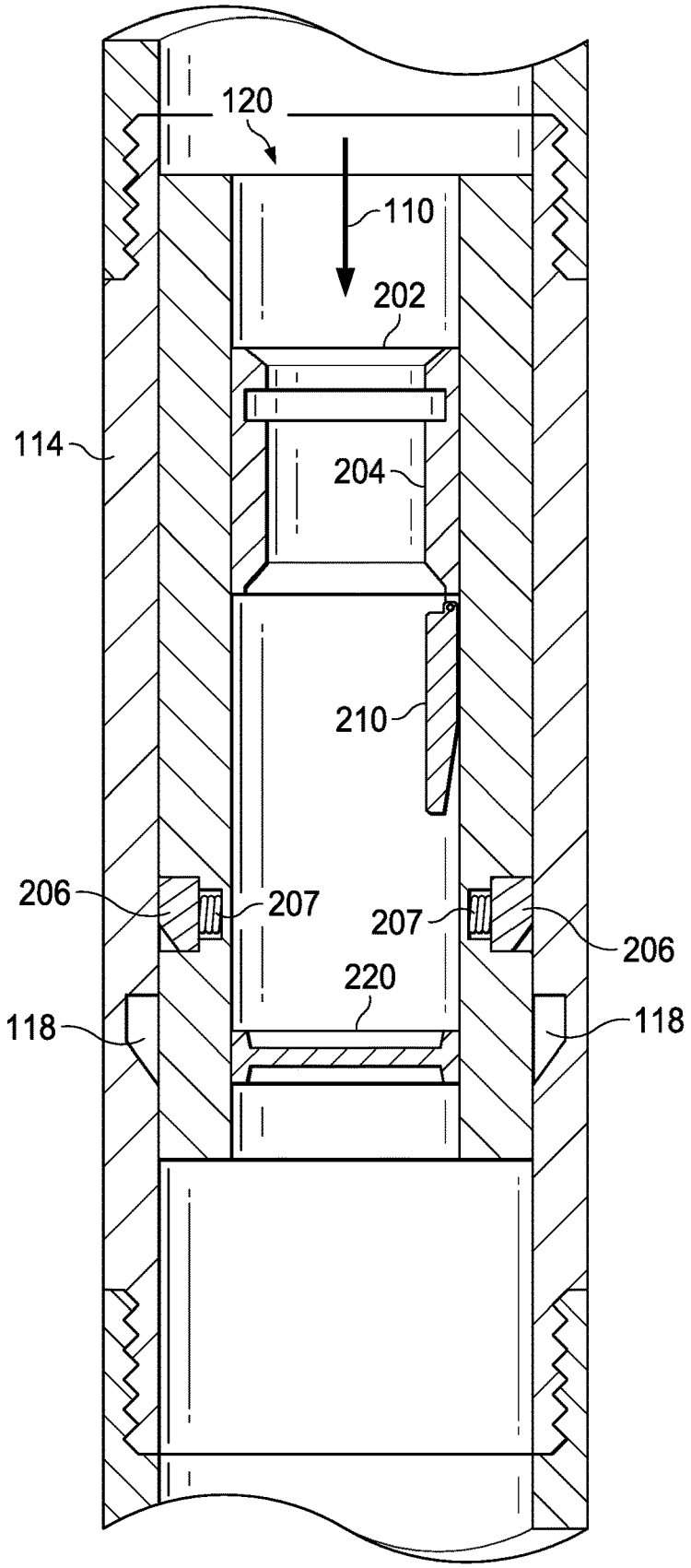
FIGS. 3A-3D are schematic diagrams of a valve assembly locking into a landing sub in accordance with an embodiment of the present disclosure.
Figure 3B:
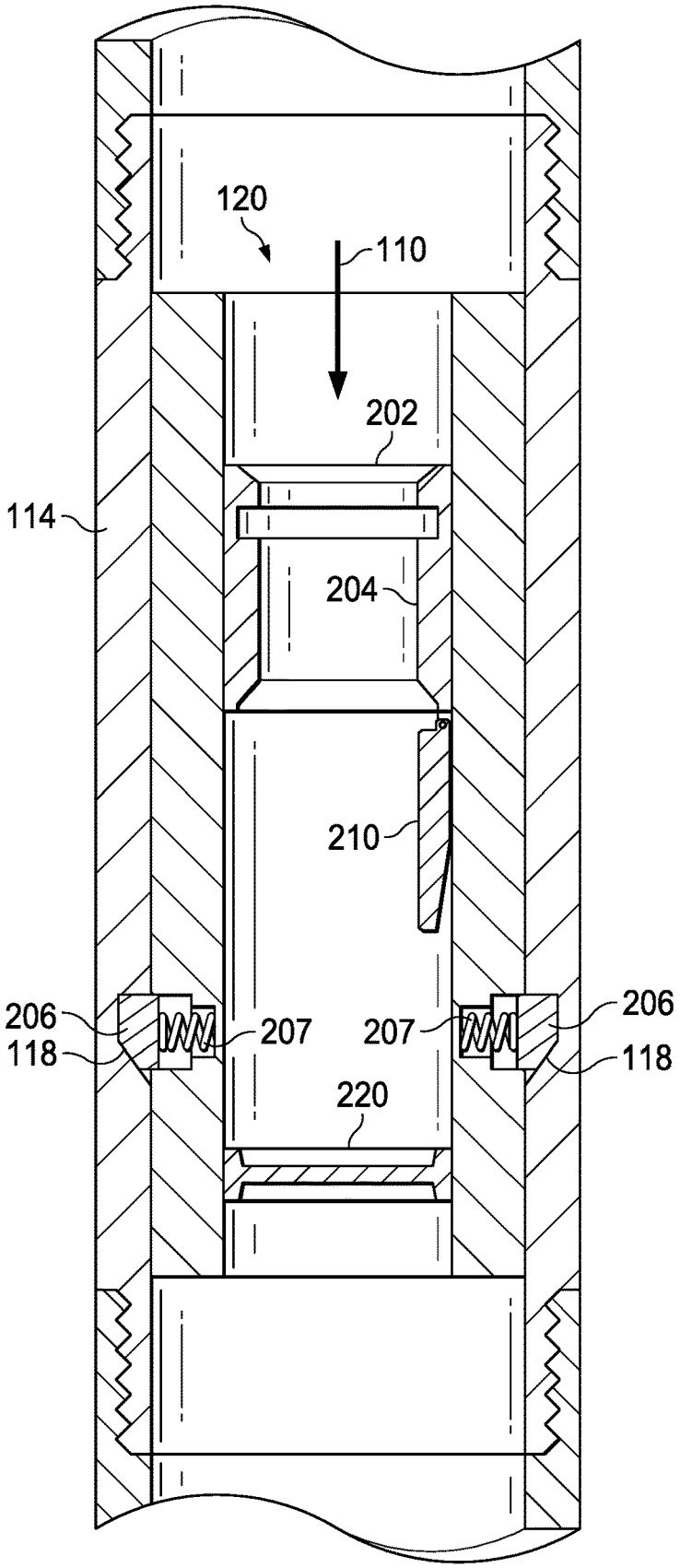

In some embodiments, the predetermined rupture pressure for rupture disc 220 is chosen such that it can withstand the fluid pressure from fluid 110 above valve assembly 120 as it is pumped down the hole. As shown in FIGS. 3A, the fluid 110 pushing against rupture disc 220 can push valve assembly 120 rapidly in the downhole direction and into landing sub 114. Setting dogs 206 are biased outward by springs 207, but the fluid pressure provides sufficient force to overcome the friction from the dogs 206 against the inner surface of landing sub 114. In this way, rupture disc 220 allows valve assembly 120 to be quickly and efficiently pushed into locking valve assembly 120 and into locking profile 116 such that the setting dogs 206 can then snap back into the outward position, thus latching valve assembly 120 within landing sub 114, as shown in FIG. 3B. In some embodiments, the predetermined rupture pressure can be about 1600 pounds per square inch (psi). In other embodiments, rupture disc 220 can have another suitable predetermined rupture pressure.

Figure 3C:
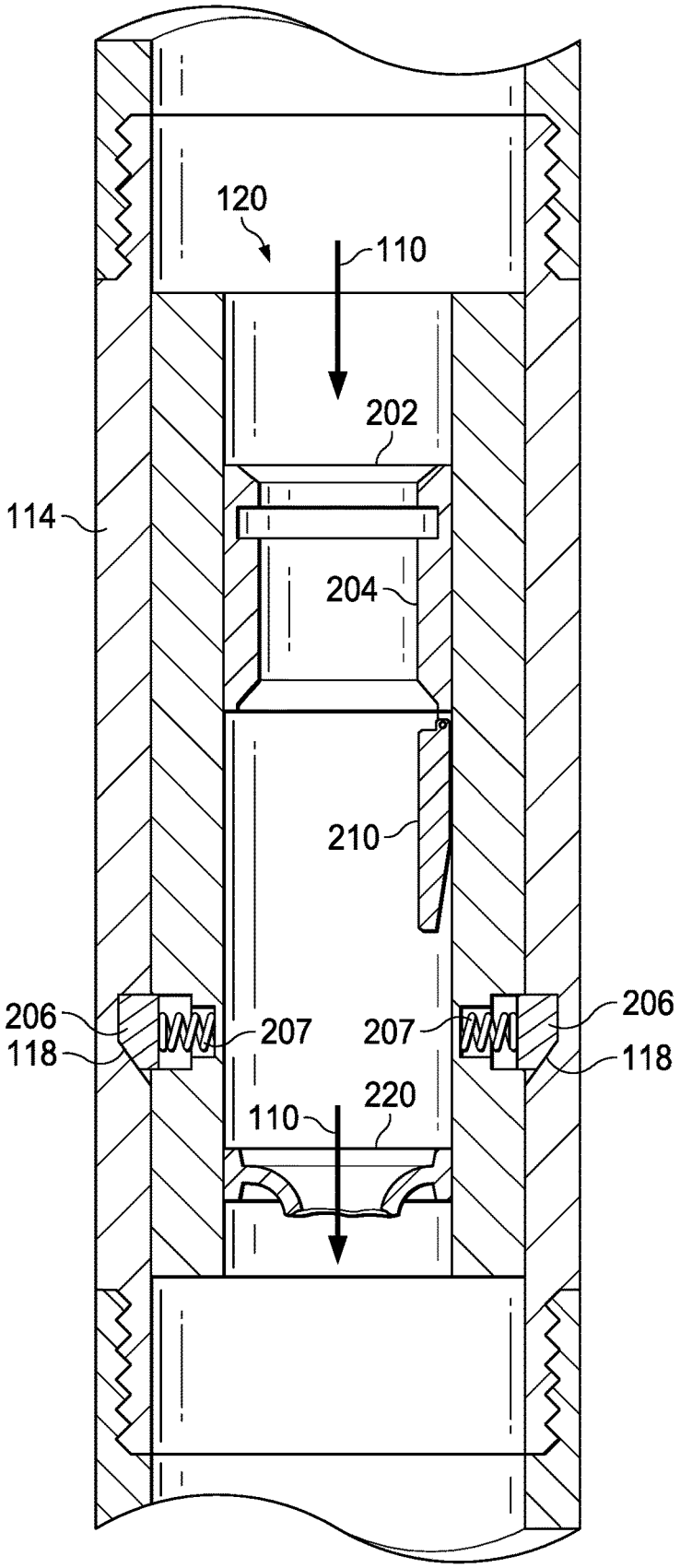
Figure 3D:
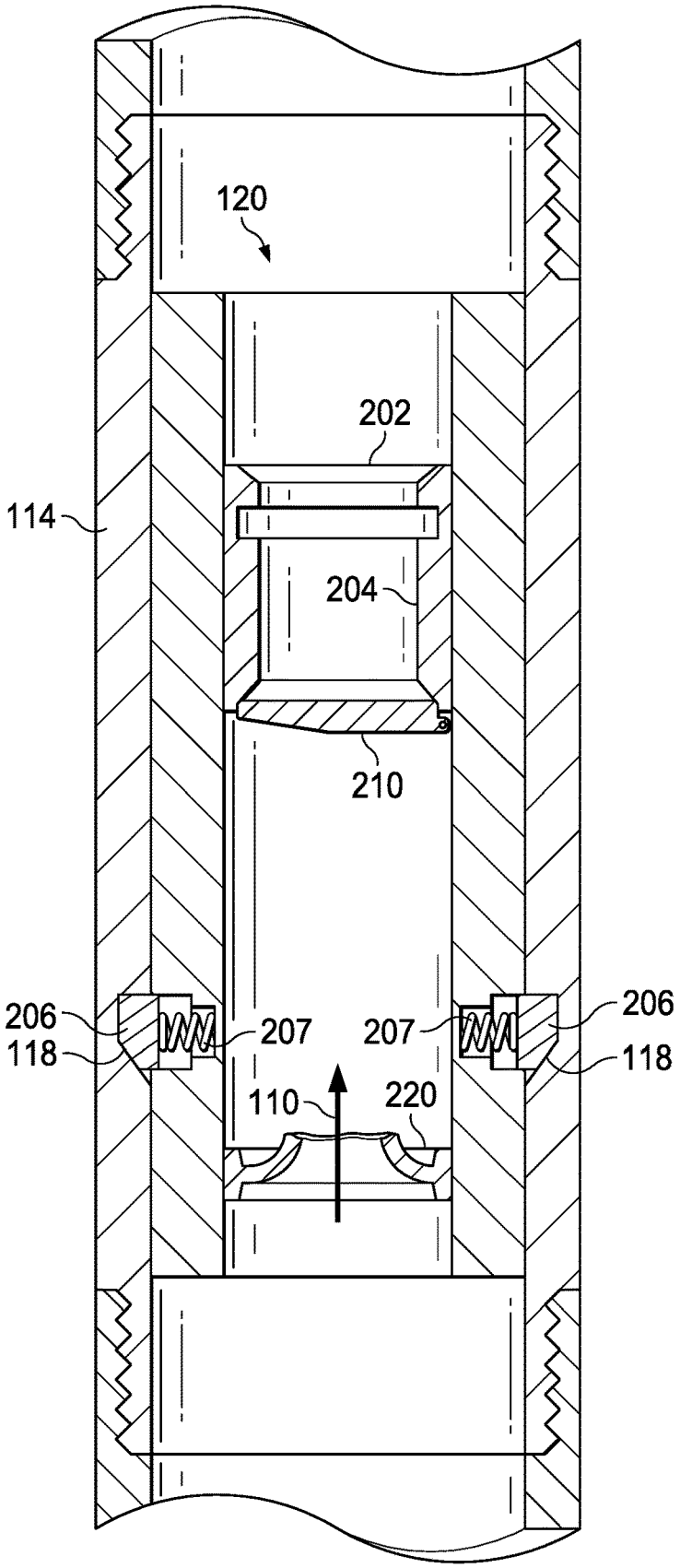

After valve assembly 120 is latched into landing profile 116, the pressure of fluid 110 can be increased (such as via a surface pump or other mechanism) so as to cause rupture disc 220 to rupture, as shown in FIG. 3C. Valve assembly 120 is thus configured to allow fluid 110 to continue flow in a downhole direction through valve central bore 204 (for example, during continuing normal drilling operations). In the event of flow in the uphole direction (for example, from a pressure kick or other well control event), valve assembly 120 is configured to prevent flow in the uphole direction. Specifically, flapper 210 is configured to close as shown in FIG. 3D in response to such upward flow, preventing the flow of fluid in the uphole direction through valve assembly 120.

Figure 4:
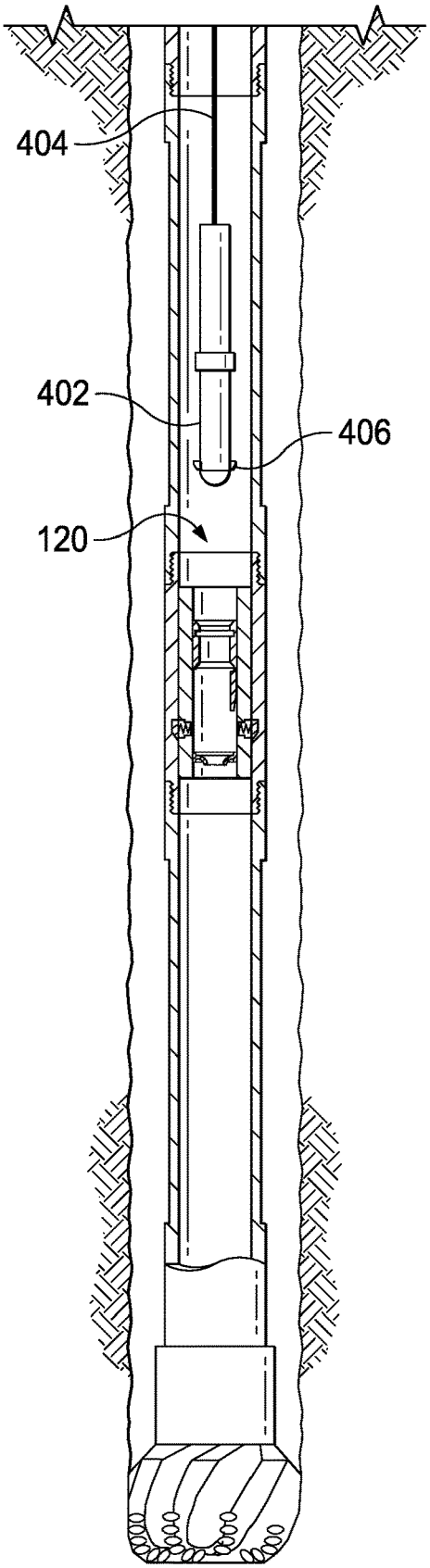
FIG. 4 is a schematic diagram of a retrieval tool deployed in the well system of FIGS. 1A-1C in accordance with an embodiment of the present disclosure.
Figure 5A:
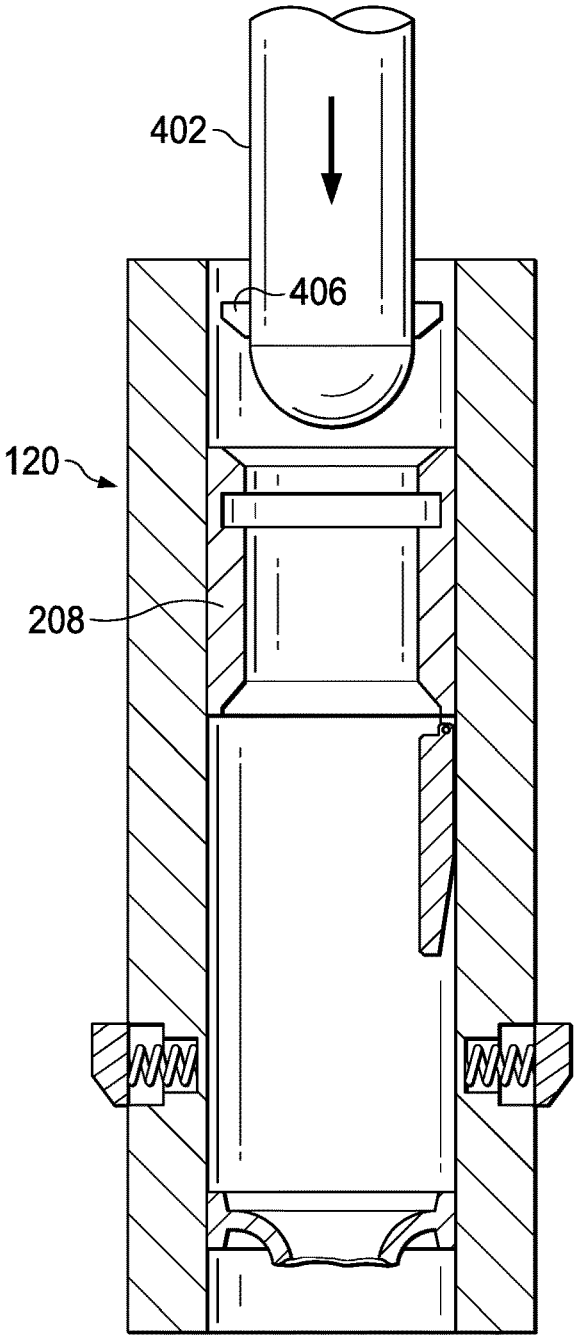
FIGS. 5A-5C are schematic diagrams of a retrieval tool locking into the valve assembly in accordance with an embodiment of the present disclosure.
Figure 5B:
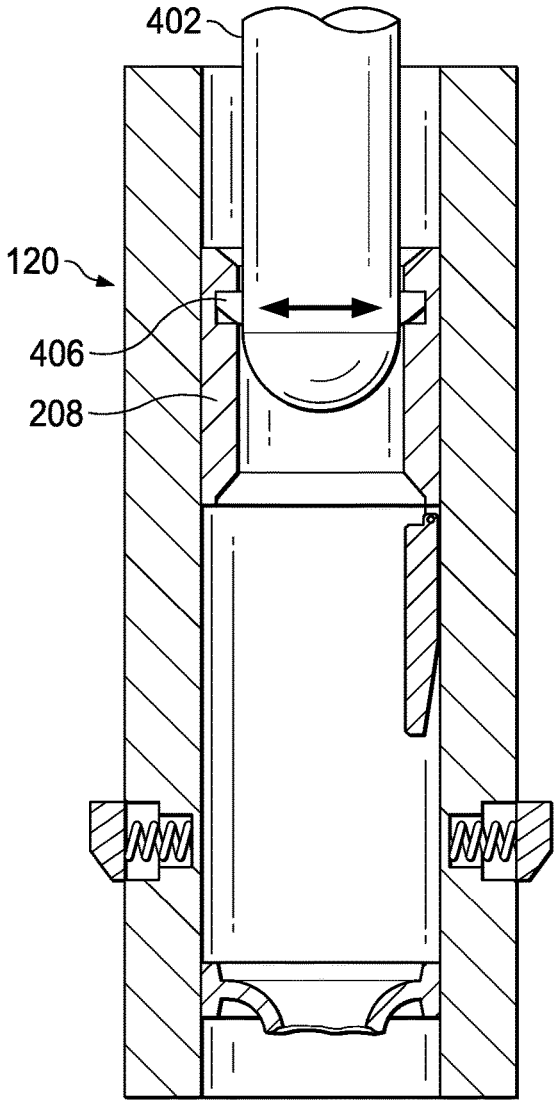
Figure 5C:
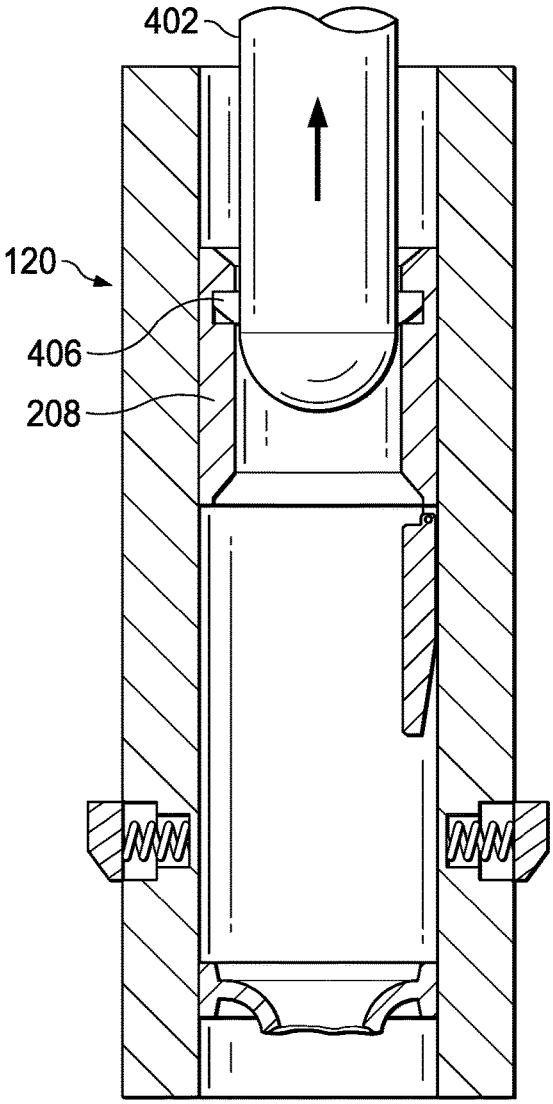

In the illustrated embodiment, valve assembly 120 is retrievable and includes an inner retrieval profile 208. A retrieval tool such as retrieval tool 402 shown in FIG. 4 can be lowered into tubular string 106 via slickline 404 or another suitable conveyance, as shown in FIG. 5A. Retrieval tool 402 include tool togs 406 which can be biased outward by internal springs (not shown) and latch into retrieval profile 208 as shown in FIG. 5B. Once latched, as shown in FIG. 5C, retrieval tool 402 can be pulled upwards to pull valve assembly 120 upwards and out of landing sub 114 and out of tubular string 106. In some embodiments, dogs 206 can be configured to shear in response to application of a sufficient predetermined upward force by retrieval tool 402. In some embodiments, retrieval tool 402 can include an unlocking mechanism (not shown) that causes dogs 206 to retract into main body 202.

In some embodiments, valve assembly 120 can include a spring which biases flapper 210 to the closed position. In some embodiments, fluid pressure required to open flapper 210 (against the force of the spring) is less than the predetermined pressure to rupture disc 220. In such embodiments, a relatively high fluid pressure and flow rate in the downhole direction can be used to pump valve assembly 120 quickly down tubular 106 and forcefully latch it into landing sub 114, but during normal operations (after valve assembly is landed and latched and the rupture disc is ruptured) a relatively low fluid pressure and flow rate in the downhole direction would keep flapper 210 open.

In some embodiments, instead of dropping valve assembly 120 into tubular string after tubular string 106 is inserted in wellbore 102 as described above, valve assembly 120 can be installed in landing sub 114 before tubular string 106 is inserted in wellbore 102. In such embodiments, rupture disc 220 can be omitted from valve assembly 120.

In some embodiments, tubular string 106 can have a primary check valve installed below landing sub 114, before tubular string 106 is installed in wellbore 102. In such embodiments, valve assembly 120 can be used as a "backup" or secondary check valve that prevents upward flow of fluids in the event of a failure of the primary check valve. Valve assembly 120 an be pumped down and installed in landing sub 114 when conditions warrant such a secondary or backup device, and retrieved when conditions no longer warrant such a device. For example, for a drill string in a "wild cat" exploratory well, landing sub 114 can be installed above conventional bit sub float valve. When a high-risk zone is encountered in such a well, valve assembly 120 can be dropped into the drill string and latched into the landing sub to contain kicks when primary float valve in the string might fail to hold pressure. Once the well gets under control, valve assembly 120 can be retrieved from drill string. The primary check valve can be a flapper valve or other suitable non-return valve, and can be connected directly to a tubular segment or, like valve assembly 120, can be a pump-down device which lands in a landing sub that is connected to a tubular segment.

Figure 6:
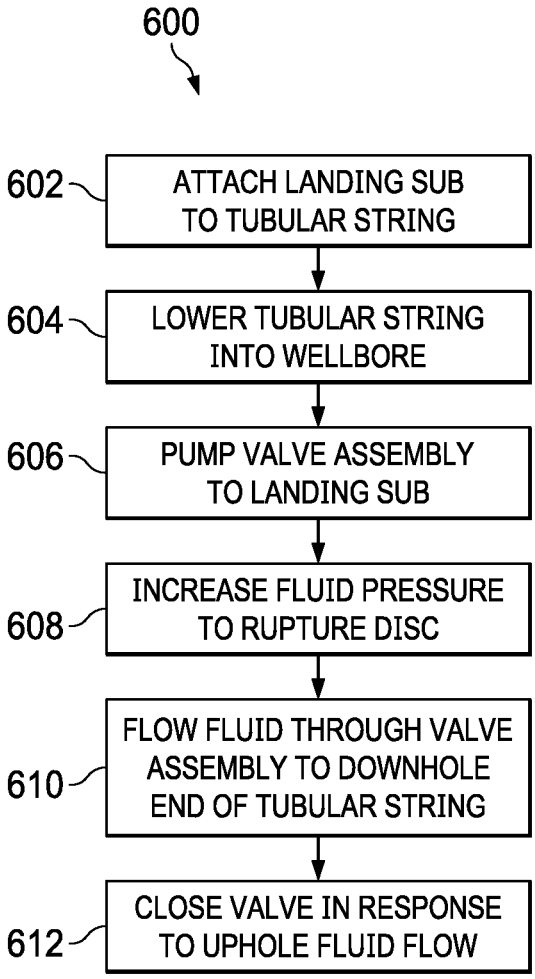
FIG. 6 is a process flow diagram of a method of installing and operating a valve assembly in accordance with an embodiment of the present disclosure.

FIG. 6 is a process flow diagram of a method 600 of installing and operating a valve assembly in accordance with an embodiment of the present disclosure. The method begins at step 602, in which a landing sub is attached to the tubular string. In some embodiments, the landing sub can be a landing sub as shown in reference to FIGS. 1A-1C and can be installed on a bottom end of one of the tubular segments 107 of the tubular string 106. The landing sub can include a landing sub central bore and a landing sub locking profile on an inner surface of the landing sub central bore.

Proceeding to step 604, the tubular string is lowering into a wellbore drilled into a subterranean zone. At step 606, a non-return valve assembly such as valve assembly 120 described in reference to FIG. 2 is dropped into the tubular string from the surface and pumped down (using a surface pump or other suitable mechanism) in a downhole direction through the tubular string until the valve assembly lands within and latches into the landing sub. As described above in reference to FIG. 2, the valve assembly can include a flapper configured to pivot between a closed position (in which the flapper seals against a flapper seat and blocks fluid from flowing in an uphole direction through the valve central bore) and an open position, and a rupture disc.
Proceeding to step 608, the fluid pressure is increased until the rupture disc ruptures, thus causing the flapper to pivot to the open positon and allowing (at step 610) fluid flow in a downhole direction through the valve assembly. At step 612, in response to fluid flow in an uphole direction, the flapper pivots to the closed position, thus preventing further flow in the uphole direction.

While this specification contains many specific implementation details, these should not be construed as limitations on the scope of what may be claimed, but rather as descriptions of features that may be specific to particular implementations. Certain features that are described in this specification in the context of separate implementations can also be implemented, in combination, in a single implementation. Conversely, various features that are described in the context of a single implementation can also be implemented in multiple implementations, separately, or in any sub-combination. Moreover, although previously described features may be described as acting in certain combinations and even initially claimed as such, one or more features from a claimed combination can, in some cases, be excised from the combination, and the claimed combination may be directed to a sub-combination or variation of a sub-combination.

As used in this disclosure, the terms "a," "an," or "the" are used to include one or more than one unless the context clearly dictates otherwise. The term "or" is used to refer to a nonexclusive "or" unless otherwise indicated. The statement "at least one of A and B" has the same meaning as "A, B, or A and B." In addition, it is to be understood that the phraseology or terminology employed in this disclosure, and not otherwise defined, is for the purpose of description only and not of limitation. Any use of section headings is intended to aid reading of the document and is not to be interpreted as limiting; information that is relevant to a section heading may occur within or outside of that particular section.

Particular implementations of the subject matter have been described. Other implementations, alterations, and permutations of the described implementations are within the scope of the following claims as will be apparent to those skilled in the art. While operations are depicted in the drawings or claims in a particular order, this should not be understood as requiring that such operations be performed in the particular order shown or in sequential order, or that all illustrated operations be performed (some operations may be considered optional), to achieve desirable results. In certain circumstances, multitasking or parallel processing (or a combination of multitasking and parallel processing) may be advantageous and performed as deemed appropriate.

Moreover, the separation or integration of various system modules and components in the previously described implementations should not be understood as requiring such separation or integration in all implementations, and it should be understood that the described components and systems can generally be integrated together or packaged into multiple products.

Accordingly, the previously described example implementations do not define or constrain the present disclosure. Other changes, substitutions, and alterations are also possible without departing from the spirit and scope of the present disclosure.

What is claimed is:

1. A well system, comprising:

a drill string positioned in a wellbore drilled into a subterranean zone, the drill string comprising a plurality of tubular segments and a drill bit at its downhole end;

a landing sub connected to a bottom end of one of the plurality of tubular segments, the landing sub comprising a landing sub central bore and a landing sub locking profile on an inner surface of the landing sub central bore; and a valve assembly configured to be pumped down the tubular string by fluid flowing in a downhole direction through the tubular string and to land within the landing sub central bore, the valve assembly comprising:

a main body with a valve central bore;

a flapper configured to pivot between an open position and a closed position, wherein in the closed position the flapper seals against a flapper seat and blocks fluid from flowing in an uphole direction through the valve central bore;

a rupture disc positioned in the valve central bore and configured to rupture in response to an application of a predetermined fluid pressure and configured to block drilling fluid from flowing through the valve central bore when in an unruptured state; and one or more valve body setting dogs positioned on an outer surface of the main body and configured to lock into the landing sub locking profile and thereby limit axial movement of the main body within the landing sub, wherein the system is configured such that, during drilling operations when the rupture disc is in the ruptured state, the valve assembly permits drilling fluid to flow through the valve central bore to the drill bit and prevents fluid flow in the uphole direction from the drill bit through the valve central bore.

2. The well system of claim 1, wherein the valve assembly further comprises an internal locking profile on an inner surface of the valve central bore, and wherein the well system further comprises a retrieval tool configured to be lowered into the tubular string and at least partially into the valve central bore, the retrieval tool comprising retrieval tool dogs configured to lock into the internal locking profile of the valve assembly and operable to pull the valve assembly in an uphole direction from the landing sub.

3. The well system of claim 1, wherein the flapper is biased to the closed positon by a spring and the predetermined fluid pressure to rupture the rupture disc is greater than a fluid pressure required to push the flapper to the open position.

4. The well system of claim 1, wherein the valve body setting dogs are biased outward by springs within the valve main body and wherein the predetermined fluid pressure to rupture the rupture disc is greater than a fluid pressure against the rupture disc that is required to push the valve assembly in a downhole direction into the landing sub such that the valve body setting dogs lock into the landing sub locking profile.

5. A well system comprising:

a tubular string comprising a plurality of tubular segments and positioned in a wellbore drilled into a subterranean zone;

a landing sub connected to a bottom end of one of the plurality of tubular segments, the landing sub comprising a landing sub central bore and a landing sub locking profile on an inner surface of the landing sub central bore;

a primary check valve assembly installed in the tubular string below the landing sub, the primary check valve assembly configured to allow the flow of fluids in the downhole direction and to prevent the flow of fluids in the uphole direction in the tubular string; and a secondary check valve assembly i-s-operable to prevent the flow of fluids in the uphole direction in the tubular string in the event of a failure of the primary check valve assembly, the secondary check valve assembly configured to be pumped down the tubular string by fluid flowing in a downhole direction through the tubular string and to land within the landing sub central bore and comprising:

a main body with a valve central bore;

a flapper configured to pivot between an open position and a closed position, wherein in the closed position the flapper seals against a flapper seat and blocks fluid from flowing in an uphole direction through the valve central bore;

a rupture disc positioned in the valve central bore and configured to rupture in response to an application of a predetermined fluid pressure and configured to block fluid from flowing through the valve central bore when in an unruptured state; and one or more valve body setting dogs positioned on an outer surface of the main body and configured to lock into the landing sub locking profile and thereby limit axial movement of the main body within the landing sub.

6. A method comprising:

attaching a landing sub to a bottom end of one of a plurality of tubular segments of a drill string, the landing sub comprising a landing sub central bore and a landing sub locking profile on an inner surface of the landing sub central bore and the drill string comprising a drill string at its downhole end;

lowering the drill string into a wellbore drilled into a subterranean zone;

pumping, by a flow of drilling fluid through the tubular string, a valve assembly in a downhole direction through the tubular string until the valve assembly lands within the landing sub central bore and valve body setting dogs positioned on an outer surface of a main body of the valve assembly lock into the landing sub locking profile, wherein the valve assembly comprises:

a flapper configured to pivot between an open position and a closed position, wherein in the closed position the flapper seals against a flapper seat and blocks fluid from flowing in an uphole direction through the valve central bore;

a rupture disc positioned in the valve central bore and configured to rupture in response to an application of a predetermined fluid pressure and to block fluid from flowing through the valve central bore when in an unruptured state;

increasing a fluid pressure of the drilling fluid in the tubular string until the rupture disc ruptures; and during drilling operations after rupture of the rupture disc, flowing drilling fluid through the valve assembly to the drill bit.

7. The method of claim 6, further comprising:

pivoting, by flowing fluid in a downhole direction, the flapper to the open position; and flowing fluid in a downhole direction through the tubular string and through the valve assembly to a downhole end of the tubular string below the landing sub.

8. The method of claim 6, further comprising pivoting, in response to a flow of fluid in an uphole direction, the flapper to the closed position.

9. The method of claim 6, wherein the valve assembly further comprises an internal locking profile on an inner surface of the valve central bore, and wherein the method further comprises:

after rupture of the rupture disc, lowering a retrieval tool into the tubular string towards the drill bit and at least partially into the valve central bore, the retrieval tool comprising retrieval tool dogs configured to lock into the internal locking profile of the valve assembly;

applying, by the retrieval tool, sufficient upward force to shear the valve body setting dogs;

pulling, with the retrieval tool, the valve assembly from the landing sub in an uphole direction away from the drill bit, thereby retrieving the valve assembly from the tubular string; and after the retrieving, continuing drilling operations.

10. The method of claim 6, wherein the flapper is biased to the closed positon by a spring and the predetermined fluid pressure to rupture the rupture disc is greater than a fluid pressure required to push the flapper to the open position.

11. The method of claim 6, wherein the valve body setting dogs are biased outward by springs within the valve main body and wherein the predetermined fluid pressure to rupture the rupture disc is greater than a fluid pressure against the rupture disc that is required to push the valve assembly in a downhole direction into the landing sub such that the valve body setting dogs lock into the landing sub locking profile.

12. A method comprising:

before a tubular string is lowered into a wellbore into a subterranean zone;

attaching a landing sub to a bottom end of one of a plurality of tubular segments of the tubular string, the landing sub comprising a landing sub central bore and a landing sub locking profile on an inner surface of the landing sub central bore; and installing a primary check valve assembly in the tubular string below the landing sub, the primary check valve assembly configured to allow the flow of fluids in the downhole direction and to prevent the flow of fluids in the uphole direction in the tubular string;

lowering the tubular string into the wellbore;

pumping, by a flow of fluid through the tubular string, a secondary check valve assembly in a downhole direction through the tubular string until the secondary check valve assembly lands within the landing sub central bore and valve body setting dogs positioned on an outer surface of a main body of the secondary valve assembly lock into the landing sub locking profile, the secondary check valve assembly operable to prevent the flow of fluids in the uphole direction in the tubular string in the event of a failure of the primary check valve assembly, the secondary check valve assembly comprising:

a flapper configured to pivot between an open position and a closed position, wherein in the closed positon the flapper seals against a flapper seat and blocks fluid from flowing in an uphole direction through the valve central bore;

a rupture disc positioned in the valve central bore and configured to rupture in response to an application of a predetermined fluid pressure and to block fluid from flowing through the valve central bore when in an unruptured state; and increasing a fluid pressure of the fluids in the tubular string until the rupture disc ruptures.

* * * * *